US005368473A

United States Patent [19]

Kenjiro et al.

[11] Patent Number: 5,368,473

[45] Date of Patent: * Nov. 29, 1994

[54] GAS LIGHTER WITH SAFETY DEVICE

[75] Inventors: Uematsu Kenjiro; Kaga Yosimitu; Saito Masaki, all of Shizuoka, Japan

[73] Assignee: Tokai Corporation, Kanagawa, Japan

[ * ] Notice: The portion of the term of this patent subsequent to Aug. 31, 2010 has been disclaimed.

[21] Appl. No.: 112,665

[22] Filed: Aug. 26, 1993

Related U.S. Application Data

[63] Continuation of Ser. No. 988,808, Dec. 10, 1992, Pat. No. 5,240,408.

[30] Foreign Application Priority Data

Jan. 13, 1992 [JP] Japan ..... 4-040078
Oct. 7, 1992 [JP] Japan ..... 4-268779

[51] Int. Cl.[5] ..... F23D 11/36

[52] U.S. Cl. ..... 431/153; 431/277; 222/153; 222/402.11

[58] Field of Search ..... 431/153, 277, 255, 267, 431/131, 253, 344; 222/153, 402.11, 402.12, 509, 518

[56] References Cited

U.S. PATENT DOCUMENTS

| | | | |
|---|---|---|---|
| 3,898,031 | 8/1975 | Rusakowicz | 431/254 |
| 4,424,920 | 1/1984 | Tada | 222/153 |
| 4,752,020 | 6/1988 | Grueter | 222/153 |
| 4,784,602 | 11/1988 | Nitta | 431/153 |
| 4,786,248 | 11/1988 | Nitta | 431/153 |
| 4,832,596 | 5/1989 | Morris, Sr. | 431/153 |
| 4,859,172 | 8/1989 | Nitta | 431/153 |
| 4,904,180 | 2/1990 | Nitta | 222/153 |
| 4,921,420 | 5/1990 | Johnston | 431/153 |
| 5,002,482 | 3/1991 | Fairbanks et al. | 431/153 |
| 5,074,781 | 12/1991 | Fujita | 431/277 |
| 5,120,215 | 6/1992 | Nolla | 431/153 |
| 5,145,358 | 9/1992 | Shike et al. | 431/277 |
| 5,228,849 | 7/1993 | Frigiere | 431/153 |
| 5,240,408 | 8/1993 | Kenjiro et al. | 431/153 |
| 5,242,297 | 9/1993 | Cirami | 431/277 |

FOREIGN PATENT DOCUMENTS

| | | |
|---|---|---|
| 0514287 | 11/1992 | European Pat. Off. . |
| 1-178456 | 12/1989 | Japan . |
| 3-25215 | 2/1991 | Japan . |
| 3-501647 | 4/1991 | Japan . |
| 3-35971 | 7/1991 | Japan . |

*Primary Examiner*—James C. Yeung
*Attorney, Agent, or Firm*—Brumbaugh, Graves, Donohue & Raymond

[57] ABSTRACT

A gas lighter with a safety device which is composed of a lock lever and a resilient leaf. The resilient leaf is defined, on the upper portion of a lighter body and on the path of a depressible actuating means, by a pair of slits formed parallel to each other and longitudinally. The resilient leaf, which is slidably surrounded with the lock lever, is at the upper end thereof incurved towards the lighter body. When the lock lever is positioned at the lowermost end of the slits, i.e., a locked position, the incurved portion of the resilient leaf is engaged with a recess at the lowermost end of the actuating means, thereby preventing the depression of the actuating means. When the lock lever is thrust uppermost along the slits, i.e., up to an unlocked position, the incurved end of the resilient leaf is forcibly straightened, whereby the disengaged actuating means can be depressed.

25 Claims, 9 Drawing Sheets

GAS LIGHTER WITH SAFETY DEVICE

This application is a continuation of application Ser. No. 07/988,808, field on Dec. 10, 1992, U.S. Pat. No. 5,240,408.

BACKGROUND OF THE INVENTION

1. Field of the Invention

This invention relates to a gas lighter ignitable upon depression of an actuating means and, more particularly to a lighter with a safety device which remains deactivated by the engagement of a resilient member with an actuating means but can be activated by rendering the resilient member deformed.

2. Description of the Prior Art

Though a gas lighter is a convenient tool which can easily be ignited by the depression of the service end of an actuating lever, it can be a safety hazard for those who, like children, are unfamiliar with the proper use of the lighter. In addition, the lighter may be ignited by the unintentional depression of the service end happenly upon contact with stuffs.

In response to the demands for a gas lighter which is improved in safety in such a manner that inadvertent ignition by those who are unfamiliar with the proper use of the lighter can surely be prevented and the unintentional ignition can be prevented, child resistant gas lighters with several types of safety devices have already been known. Most of the safety devices built into these child resistant gas lighters have a lock mechanism which prevents depression of the actuating lever and which must be released to allow the actuating lever to be depressed. However, any of the conventional-type child resistant gas lighters will have drawbacks in their usage and thus it is desirable that the gas lighter be improved for practical use.

For instance, as disclosed in U.S. Pat. Nos. 4,859,172, 4,786,248, and 4,784,602 and Japanese Utility Model Publication No. 3(1991)-35971, any one of the disclosed safety devices is provided with a lock member for deterring depression of the actuating lever. Since the lock member is manually movable between a locked position and a released position, the lock member tends to stay at the released position without a manual recovery from the released position to the initial position after the use of the lighter, whereby the safety device remains unlocked. Leaving the lock member at the released position permits the actuating lever to be depressed, rendering the safety device inoperable. Specifically then, to ensure safety, the existing safety devices always require a manual re-locking operation after the use of the lighter with the lock mechanism unlocked, and hence there were expected further improvements of the lock mechanism in terms of safety.

To solve the drawbacks set forth above, there have been proposed, as a safety device having a lock member to impede the depression of the actuating lever, safety devices with what is called an auto-return function wherein the lock member automatically returns to the locked position in response to the ignition operation after the lock member has been manually moved to the released position. U.S. Pat. Nos. 5,002,482, and 3,898,031, and Japanese Unexamined Patent Publication No. 3(1991)-25215, for instance, disclose such safety devices as having the autoreturn function which allows automatic return of the lock member to the locked position in response to the ignition operation. With these safety devices, however, releasing the lock mechanism is only achieved by the motion of a finger along an L-shaped path, thereby resulting in the lock mechanism being inferior, in terms of operability, in the ease of releasing the lock member such that a lighter of this type generally requires operation with a single finger, such as a thumb, thus leading to different results depending on the users. Therefore, safety devices of this type can be said to be disadvantageous in practical use. Further, the operation of these safety devices is unreliable because of a probability that the lock member will return to the locked position by its own reactive force which is due to the resilience of the material constituting the lock member.

Furthermore, there have been proposed safety devices wherein the lock member is released by the motion of a finger not along the L-shaped path, but along a simple linear path, but any of those have drawbacks in practical use. The safety device as disclosed in Japanese Patent Publication of Translated Version (PCT) No. 3(1991)-501647, for instance, is provided with an automatic return function wherein the part of a lock member being composed of a spring is moved along an arcuate path to the released position and held there, then it automatically returns to the locked position in response to the ignition operation. In this type of safety device, the arrangement for guiding the release of the spring-like lock member is not satisfactory, and accordingly the lock member cannot be steadily released. This adversely affects the ease of releasing the lock mechanism in the gas lighter, which is generally operated with a single finger, and, as with the preceding example, the resulting operations will be different depending on the users. Since the lock member itself is formed of a spring, the lock member may become deformed and cause failure of the lock mechanism after repeated use of the lighter.

In the safety device disclosed in U.S. Pat. No. 4,832,596, the lock member is moved to the released position along a linear path, but automatically returns to the initial position unless it is held at the locked position with a finger other than the one used for actuating the ignition mechanism. Thus, the lock member cannot steadily be released. This adversely affects the ease of releasing the lock mechanism in a gas lighter, which is generally operated with a single finger, e.g. the thumb, and, as with the preceding examples, leads to different operational results depending on the users.

In order to overcome such problems, there has been proposed an autoreturn safety device in which the lock member is moved along a linear path to the released position, thereby facilitating the release of the lock mechanism, and at the same time, the lock mechanism can be held in the released position with the finger which actuates the ignition mechanism, thus not requiring another finger. However, the safety device also has drawbacks in its practical use. That is, in the safety device disclosed in Japanese Unexamined Utility Model Publication No. 1(1989)-178456, the lock member is incorporated in the actuating lever which is actuated to ignite the lighter and the actuating lever can be operated with use of the same finger that has been used in releasing the lock member, i.e. the thumb which is generally used in an ignition operation, thus facilitating the releasing operation. However, when the actuating lever is actuated with the same finger (usually the thumb) which previously moved the lock member to the released position, the lock member may inadvertently be released from the thumb and may return to the locked position. Accordingly, also in this safety device, the lock member cannot be steadily released. This adversely affects the ease of releasing the lock mechanism in the gas lighter, which is generally operated with a single finger, e.g. the thumb, and, as with the preceding examples, this leads to different operational results depending on the users.

As can be seen from the description above, any one of the existing child resistant safety devices has drawbacks in practical use, and hence there has been a demand for a child resistant safety device which is improved in both safety and operability.

Further, in manufacturing gas lighters with such a safety device, it is required to rationalize the assembling steps, to improve assembling accuracy, thereby further enhancing the handling of the safety device, and to reduce the manufacturing cost.

SUMMARY OF THE INVENTION

In view of the foregoing observations and description, the primary object of this invention is to provide a gas lighter with a safety device, which enables the lighter to be ignited by the depression of an actuating means and the automatic recovery of a lock lever to a locked position associated with the action of the actuating means, wherein, when not in use, the lighter is locked to prevent the ignition whilst, when in use, the lighter is released from the locked state by the actuation of the lock lever.

Another object of this invention is to provide a gas lighter with a safety device which can prevent the lock lever from being left at the unlocked position, and which can ensure the lock of the actuating means when the lighter is not in use.

A further object of this invention is to provide a gas lighter with a safety device simple in structure and inexpensive to manufacture.

To these ends, according to one aspect of this invention, there is provided a gas lighter with a safety device including a lighter body containing fuel gas, a fuel supply means for supplying the fuel gas contained in the lighter body to a nozzle at a regulated flow rate, an ignition means for igniting the fuel gas evolved from the nozzle, and a depressible actuating means for opening and closing the fuel flow channel of the fuel supply means connected to the nozzle, wherein the improvement comprises:

a pair of parallel slits longitudinally formed, at the upper end of the lighter body, to constitute a resilient leaf therebetween, the upper part of the resilient leaf being incurred to a locked position situated below a part of the depressible actuating means, and a lock member being slidably engaged with the resilient leaf in such a manner as to travel longitudinally along the slits between the lowermost and the uppermost ends thereof, wherein, at the lowermost end, the lock member allows the upper part of the resilient leaf to be incurred to the locked position so that the depression of the actuating means is prevented whilst, at the uppermost end, the lock member holds the resilient leaf outside the path of the actuating means to allow the depression thereof, whereby the resilient leaf is allowed to be incurred to prevent the depression of the actuating means when the lock member is slidably thrust down to the lowermost end of the slits, and whereby the resilient leaf is held at a position outside the path of the depressible actuating means when the lock member is thrust upwardly to the uppermost end.

Accordingly, as the lock member is forced upwardly along the slits, the resilient leaf is straightened against the elasticity thereof, so that it is in alignment with the surface of the lighter body. Eventually, the resilient leaf is kept apart from the actuating means, thereby allowing the depression of the actuating means. The depression of the actuating means forces the lock lever downwardly along the slits, which in turn entails the recovery of the resilient leaf to the state partially incurved toward the lighter body, thereby preventing the depression of the actuating means and rendering the lighter inactive.

According to a second aspect of this invention, there is provided a lighter with a safety device including a lighter body containing fuel gas, a fuel supply means for supplying the fuel gas contained in the lighter body to a nozzle at a regulated flow rate, an ignition means for igniting the fuel gas evolved from the nozzle, and a depressible actuating means for opening and closing the fuel flow channel of the fuel supply means connected to the nozzle, wherein the improvement comprises:

a resilient leaf means defined on an upper portion of a lighter body by a pair of slits formed in the path of the depressible actuating means, wherein the resilient leaf means at the upper end thereof is incurved towards the lighter body in such a manner as to deter the depression of the depressible actuating means by the engagement of the incurred end of the resilient leaf means with a portion of the bottom surface of the actuating means; and a lock means surrounding the resilient leaf means and being provided along the slits in a slidable fashion between a locked position, located at the lowermost end of the slits, and an unlocked position, located at the uppermost end of the same, wherein at the unlocked position the lock lever means forcibly straightens, longitudinally, the incurved resilient leaf means so as to disengage the resilient leaf means from the depressible actuating means, and wherein the lock lever means is thrust downwardly upon contact with a part of the lower surface of the depressible actuating means, whereby the lock means, located at the locked position, is returned to the locked position associated with the depression of the depressible actuating means.

In a preferred mode, the resilient leaf means may be provided with a stopper which hinders the upthrust of the lock lever when engaged with the lock lever between the locked position and the unlocked position. This stopper may be arranged to be disengaged from the lock lever by the inward pressing of the lock lever.

In the case of a discharge-ignition type gas lighter, the foregoing depressible actuating means may be constituted in the form of an operating cap which includes a piezoelectric generator, whilst in the case of a flint type gas lighter the ignition means may be composed of a file and a flint and the depressible actuating means may be constituted of a gas lever.

According to a gas lighter with a safety device exemplifying this invention, while the lock means is situated at the locked position, i.e., the lowermost end of the slits, the incurved end of the resilient leaf makes an abutment with a portion at the bottom end of the depressible actuating means, thereby preventing the depression of the depressible actuating means and rendering the lighter locked. Accordingly, as the lock lever is thrust upwardly along the slits, the incurred resilient leaf is straightened against the resilience thereof, and the actuating means is disengaged from the resilient leaf, thereby rendering the actuating means depressible. Fuel gas resulting from the depression of the actuating means is ignited by the ignition means. In conjunction with the depression of the actuating means, the lock means is thrust down to the locked position located at the lowermost end of the slits, whereupon the straightened resilient leaf resumes its original position with the result that the depression of the actuating means is prevented which, in turn, deters the inadvertent ignition of the lighter. Thus, according to this invention, a gas lighter which is much superior in safety will be provided.

As previously described, the stopper is provided on the resilient leaf which prevents the upthrust of the lock means between the locked position and the unlocked position when engaged with the lock means. The inward press of the lock means only disengages the lock lever from the stopper. Since such an arrangement requires two-staged unlocking operations, the gas lighter with this lock mechanism will be difficult to activate for those who are unfamiliar with the proper use of the lighter, and will ensure the prevention of inadvertent ignition of the lighter.

DETAILED DESCRIPTION OF THE PREFERRED EMBODIMENTS

Figure 1:
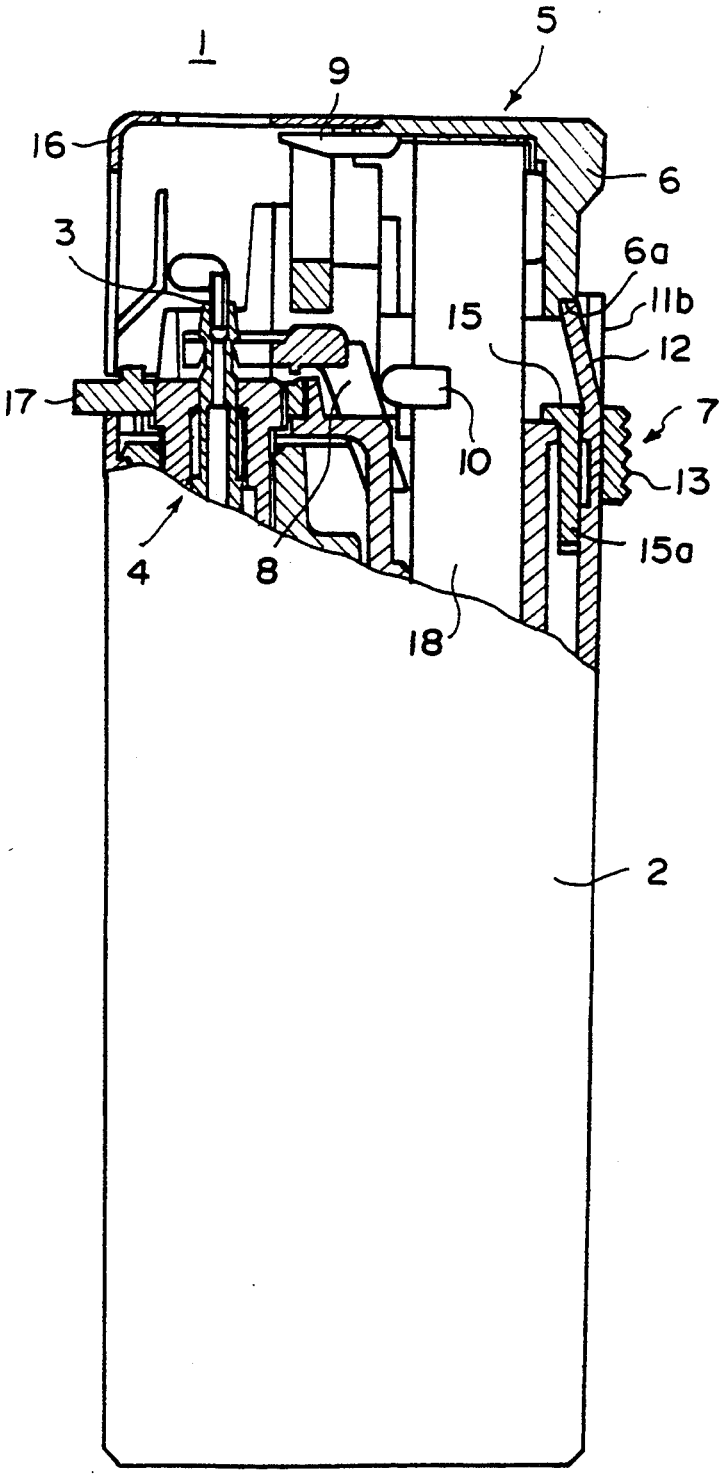
FIG. 1 is a vertical side cross-sectional view showing a chief portion of a gas lighter with a safety device according to a first embodiment of this invention.

Referring to the accompanying drawings, preferred embodiments of this invention will be described in detail hereinbelow.

First Embodiment:

A gas lighter 1 with a safety device shown in FIGS. 1 through 5, according to this invention, is provided with a lighter body 2 containing fuel gas, a fuel supply means 4 having a nozzle 3 for evolving fuel gas, an operation cap 6 integrated with an actuating means 5, which strikes a piezoelectric generator to produce sparks, and a lock lever 7 provided at an upper part of the lighter body 2 for rendering the operation cap 6 locked or unlocked.

The lighter body 2, substantially in the form of a rectangular parallelepiped, is made of synthetic resin, and contains fuel gas such as butane. The lighter body 2 accommodates a known fuel supply means 4 for discharging the contained fuel gas at a regulated flow rate, and the nozzle 3, provided on top of the fuel supply means 4, the nozzle 3 projecting out of the top of the lighter body 2. Disposed parallel with the upper surface of the lighter body 2 is a gas lever 8 which is, at one end thereof, engageably connected with the nozzle 3. This gas lever 8 is L-shaped, and supports at one bored end thereof the nozzle 3. The other end of the gas lever 8 extends down and in towards the lighter body 2, and the gas lever is rockably supported at the bent portion thereof.

Disposed at the end of the lighter body, opposite to the nozzle 3, is the operation cap 6 on the upper part of the lighter body 2. This operation cap 6 is slidable downwards, and incorporates a piezoelectric generator 18 for igniting the fuel gas evolved from the nozzle 3 upon depression of the cap 6 downwards. The upper part of operation cap 6 is also provided with a discharge electrode 9 connected to the piezoelectric generator 18, and this generator 18 is provided with a lever press 10 oriented opposite to the gas lever 8.

A pair of parallel slits **11*a* and 11*b* are longitudinally formed downwards at a predetermined length on the upper part of the side wall of the lighter body 2 to constitute a resilient leaf 12 which is surrounded by the lock lever 7**.

Figure 3:
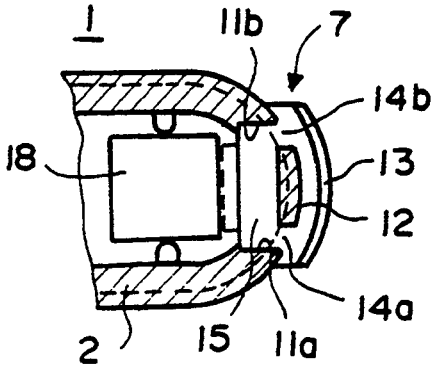
FIG. 3 is a horizontal cross-sectional view showing a chief portion of the lighter shown in FIG. 1.

As shown in FIG. 3, the lock lever 7 is comprised of a curved thumb plate 13 used when thrusting the lock lever 7 between the locked position and the unlocked position; a pair of bridges **14*a* and 14*b* stretched through the slits 11*a* and 11*b*; and a receiving element 15 for affording stability to the thumb plate 13 and receiving the bottom end of the depressed operation cap 6. The receiving element 15 is provided with, at the bottom end thereof, a downward extension, which constitutes a leg 15*a***.

The resilient leaf 12 is at an upper end thereof deformable in towards the lighter body 2, but at the bottom end thereof fixedly integrated with the lightest body. In a released state, the upper end of the resilient leaf 12 is incurved towards the lighter body As shown in FIG. 1, complementarily formed at the bottom end of the operation cap 6 is a recess **6*a* to be engaged with the uppermost end of the resilient leaf 12**.

The lock lever 7 has an opening which is constituted by the combination of the thumb plate 13, the bridges **14*a* and 14*b*, and the receiving element 15 and through which the resilient leaf 12 passes. Both sides of the thumb plate 13 of the lock lever 7 extend sideways further than the bridges 14*a* and 14*b*, and the inner surfaces of the side portions, extended sideways from the slits 11*a* and 11*b*, are in contact with the exterior surface of the lighter body 2. This causes the incurved end of the resilient leaf 12 to be straightened when the lock lever 7 is thrust upwards, whilst, when the lock lever is positioned at the lowermost end of the slits 11***a* and 11*b*, this causes the incurved end of the resilient leaf to be released. Reference numeral 16 designates a windproof cap, and 17, a fire extension regulator ring.

The operation of the lighter 1, with the safety device having the aforementioned structure, will now be described in detail.

Figure 2:
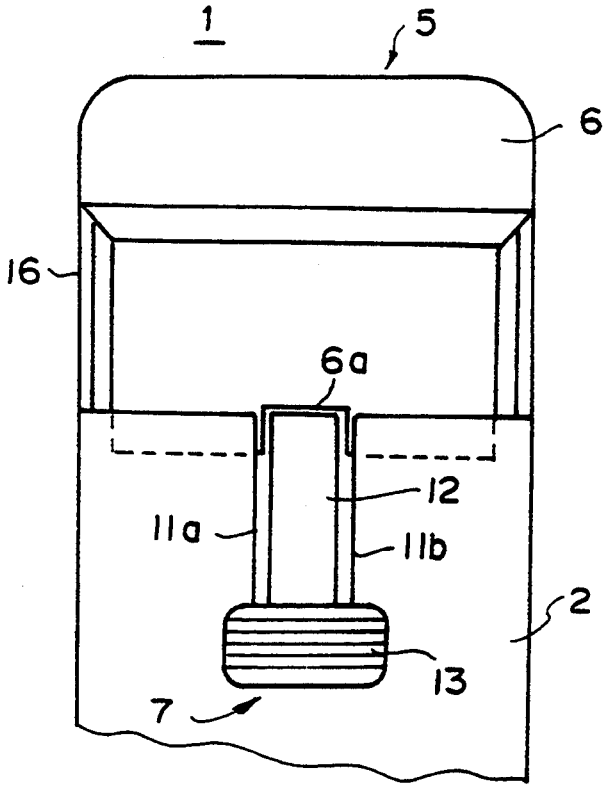
FIG. 2 is a rear view showing a chief portion of the lighter shown in FIG. 1.

As seen from FIGS. 1 and 2, in the normal state when the lock lever is positioned at the locked position, i.e., the lowermost end of the slits 11*a* and 11*b*, the resilient leaf 12 is incurred towards the lighter body 2. In this state, when depression of the operation cap 6 is attempted, the engagement between the upper end of the resilient leaf 12 and the recess 6*b* of the operation cap 6 deters the prevention of the operation cap 6, thereby preventing the piezoelectric generator 18 from receiving an impact which causes the generator to produce sparks. Thus, the safety is assured even if the gas lighter 1 is operated by those who are not familiar with the proper use thereof.

Figure 4:
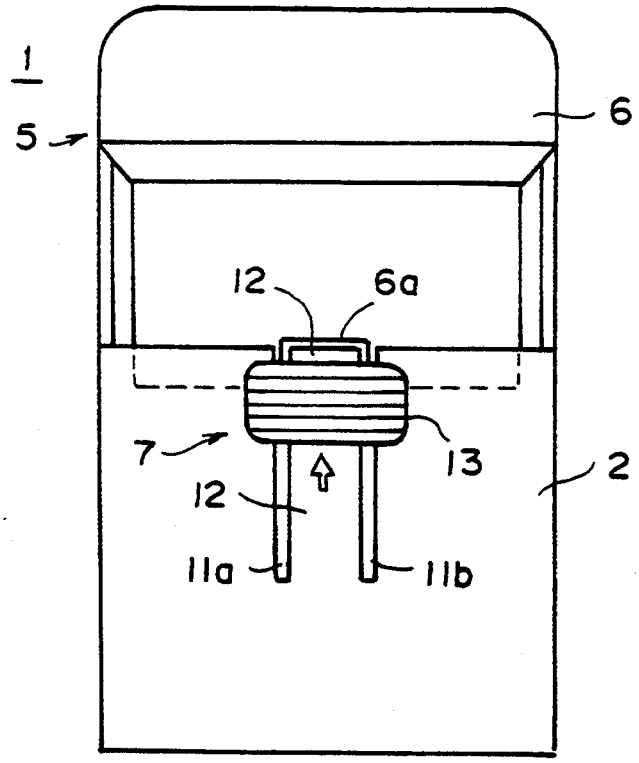
FIG. 4 is a rear view showing a chief portion of the lighter, shown in FIG. 2, in an unlocked state.

When the gas lighter 1 is in use, the lock lever 7 is raised, with the thumb plate 13, to the uppermost end of the lighter body 2 along the slits 11*a* and 11*b*, i.e., up to the unlocked position, as shown in FIG. 4. The resilient leaf 12, incurved towards the lighter body 2, is progressively straightened as the receiving element 15 of the lock lever 7 is thrust upwardly. At the unlocked position, the resilient leaf 12 is finally rendered in alignment with the top end of the lighter body 2, and the receiving element 15 is situated in proximity to the uppermost end of the lighter body 2. The straightening of the resilient leaf 12 causes the upper end of the resilient leaf 12, in engagement with the recess 6*a* at the bottom end of the operation cap 6, to be disengaged, which permits the depression of the operation cap 6.

Figure 5:
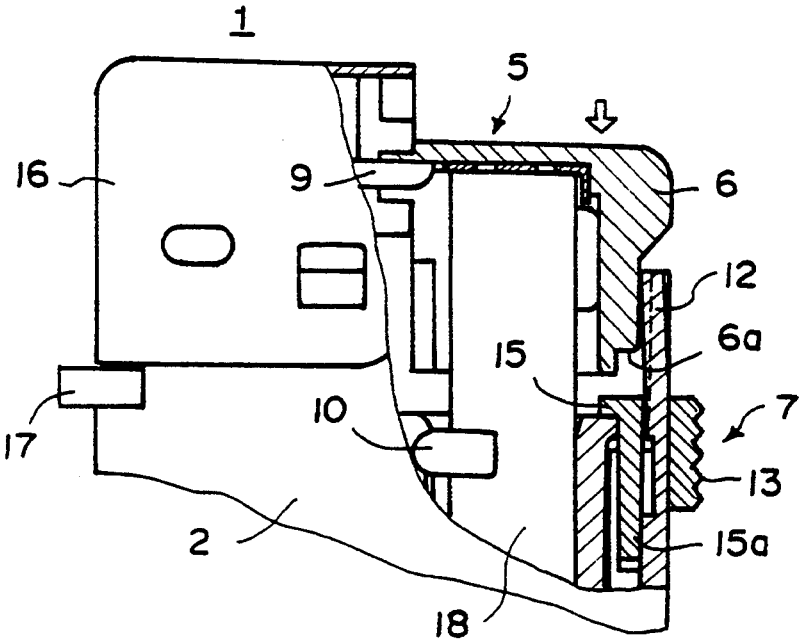
FIG. 5 is a side cross-sectional view showing a chief portion of the lighter, shown in FIG. 1, which is being ignited.

As seen from FIG. 5, when the operation cap 6 is depressed, the bottom end thereof is brought in contact with the upper surface of the receiving element 15 of the lock lever 7. Further depression of the operation cap 6 causes the receiving element 15 to be lowered, which forces the lock lever 7 to the locked position located at the lowermost end of the slits 11*a* and 11*b*.

At the same time, the depression of the operation cap 6 provides an impact to the piezoelectric device 18, which in turn activates the discharge electrode 9 to produce sparks. Associated with this, the lever press 10 thrusts the gas lever 8 forward, which in turn lifts the nozzle 3. Thereby, the nozzle 3 evolves the fuel gas, and the gas is then ignited. The shift of the lock lever 7 to the locked position results in the resilient leaf obtaining, at the upper end thereof, an inward curvature toward the lighter body, but this time this upper end makes contact with the side surface of the operation cap 6.

Upon release of a finger from the operation cap 6, in order to extinguish the fire, the operation cap 6 is lifted and returns to its original position with the help of the resilient force of a non-illustrated spring. The resilient leaf 12 is concurrently incurved toward the lighter body 2, and then the upper end of the same is engaged with the recess 6*a* at the lower end of the operation cap 6, whereby the lighter automatically returns to the locked state.

Figure 6:
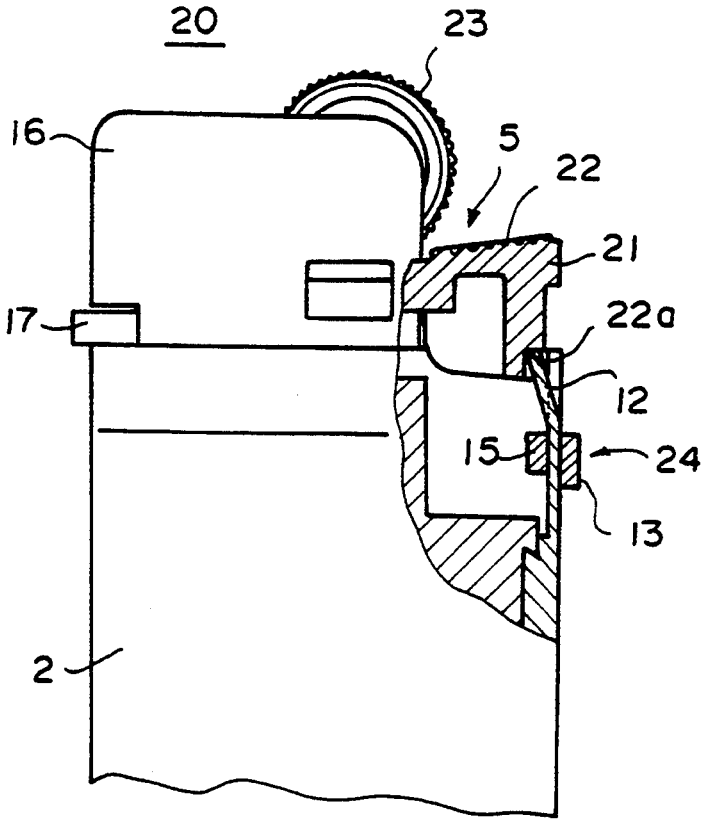
FIG. 6 is a side cross-sectional view showing a chief portion of a gas lighter with a safety device according to a second embodiment.

Second Embodiment:

FIG. 6 shows a lighter 20 with a safety device according to another embodiment of this invention, wherein the lighter employs an ignition system different from that of the first embodiment. Like reference numerals are provided to like features in the first embodiment, and detailed explanation thereof will be omitted here for clarity.

In this embodiment, the lighter is called a flint type lighter, and is provided with an ignition means which includes a non-illustrated flint and a file 23. An ignition lever 21 for regulating the evolution of gas is rockably supported, as the actuating means 5, at the upper part of the lighter body 2 by a non-illustrated pivot. The ignition lever 21, at one end thereof, engageably supports the nozzle 3 in the same manner as shown in FIG. 1, and, at the rear-side end thereof, i.e., at the bottom end of an operation means 22, is provided a recess 22*a*. This recess 22*a* is engaged with the incurved resilient leaf 12, in the same fashion as in the first embodiment, that is, towards the lighter body 2.

The lock lever 24 surrounding the resilient leaf 12 is essentially the same in structure as that in the first embodiment. The lock lever 24 goes up and down along the slits 11*a* and 11*b* depending on the operation of the thumb plate 13. When the lock lever is situated at the locked position, i.e., the lowermost end of the slits, the released resilient leaf 12 is engaged with the recess 22*a* of the operation means 22, whilst at the unlocked position, i.e., the uppermost end of the slits, the incurved resilient leaf 12 is straightened, so that the upper end of the resilient leaf 12 is disengaged from the recess 22*a*. In the case of this lock lever 24, however, the receiving element 15 has no extended portion such as the leg 15*a* in the first embodiment.

When the lighter 20 is in use, as with the first embodiment, the lock lever 24 is first lifted to the unlocked position at the uppermost end of the slits so that the upper end of the resilient leaf 12 is straightened. With this result, the recess 22*a* at the bottom end of the operation means 22 is disengaged from the upper end of the resilient leaf 12, thereby rendering the ignition lever 21 depressible. The lighter is then ignited when the ignition lever 21 is depressed in association with the rotation of the file 23.

Together with the depression of the ignition lever 21, the lock lever 24 is thrust downwards to the locked position with the receiving element 15 thereof being in contact with the bottom end of the operation means 22. When the ignition lever 21 is returned to its original elevated position to extinguish the fire, the incurred end of the resilient leaf 12 is automatically engaged with the recess 22*a* at the bottom end of the operation means 22, thereby rendering the lighter locked and the ignition lever 21 undepressible.

Third Embodiment:

FIGS. 7 through 11 illustrate a gas lighter 30 with a safety device according to a third embodiment of this invention, wherein the lighter employs an ignition system different from that of the first embodiment. Like reference numerals are provided to like features in the first embodiment, and detailed explanation thereof will be omitted here for clarity.

Like the first embodiment, the gas lighter 30 with a safety device, according to this embodiment, is composed of the lighter body 2, the fuel supply means 4 which incorporates the nozzle 3 and the gas lever 8, the operation cap 6 integrated with the actuating means 5, which actuating means strikes the piezoelectric generator 18 to produce sparks, and a lock lever 31 for rendering the operation cap 6 locked or unlocked. In the lighter body 2, a container for containing fuel gas is constituted by the combination of a tank 2*a* with a top cover 2*b* disposed on the upper surface of the tank. Separated from the tank, an intermediate case 2*c* is connectively provided on top of the top cover.

Figure 8:
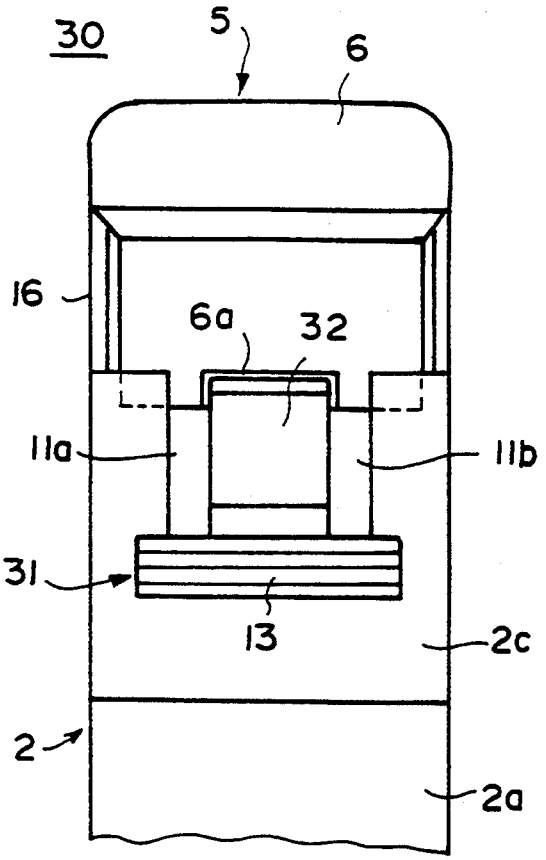
FIG. 8 is a rear view showing the gas lighter shown in FIG. 7.

In FIG. 8, on the side surface of the intermediate case 2*c*, continuously stretching from the side wall of the tank 2*a*, a pair of slits 11*a* and 11*b* are formed downwards, longitudinally, at a predetermined length so as to constitute a resilient leaf 32 which is surrounded by a lock lever 31.

Figure 10:
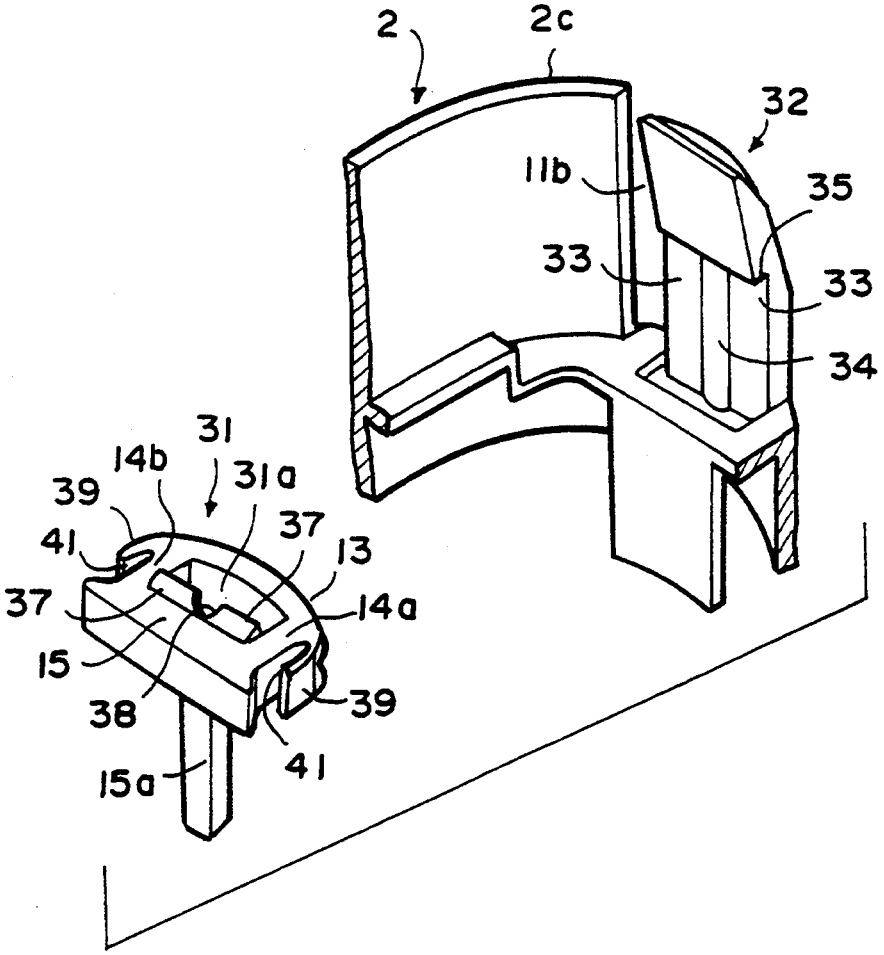
FIG. 10 is an exploded perspective view showing a resilient leaf and a lock lever of the lighter shown in FIG. 7.

In this embodiment, the upper end of the resilient leaf 32 is incurved towards the lighter body 2, and is engaged with the recess 6*a* at the bottom of the operation cap 6 so as to hinder the depression of the operation cap 6 when it is in a disengaged state. The inner surface of the resilient leaf 32 is provided, remotely from the upper end thereof, with a pair of guide channels 33 which stretch downwards. The guide channels 33 are divided at the center thereof by a raised rail 34. In FIG. 10, formed at the uppermost end of the guide channels is a stopper 35 which makes an abutment with the uppermost end of an engaging element 37 of the lock lever 37, as will be described later. The remaining portion of the resilient leaf 32 above the stopper 35 is incurved.

Figure 9:
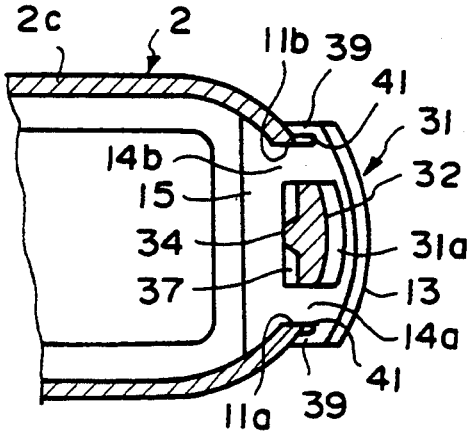
FIG. 9 is a horizontal cross-sectional view showing a chief portion of the gas lighter shown in FIG. 7.

As seen from FIGS. 9 and 10, this lock lever 31 is further provided with, in the same manner as the previous embodiment, the thumb plate 13, a pair of bridges 14*a* and 14*b* which pass through the slits 11*a* and 11*b*, and the receiving element 15 which makes a contact with the lowermost end of the operation cap 6. An opening 31*a*, through which the resilient leaf 32 travels, of the resilient leaf 32 is provided with at the inside thereof, the engaging element 37, which makes a slidable contact with the guide channels 33, and a longitudinal flute 38, with which the raised rail 34 fits. Provided on the bottom surface of the receiving element 15 is a downwardly extended portion 15*a*, and the flue 38 of the receiving element longitudinally stretches further along this extended portion 15*a* without an interruption. The engaging element 37 is upgraded towards the opening, and the counterpart stopper 35, at the uppermost end of the channels 33 of the resilient leaf 32, is, at the innermost end thereof, angularly cornered so that the engaging element can be securely engaged with the stopper.

Both sides of the thumb plate 13 of the lock lever 31 deformably extend in the shape of leg so as to make a slidable contact with the exterior surface of the intermediate case 2*c* outside the slits 11*a* and 11*b*. A gap 41 between the thumb plate 13 and the deformable leg affords a resiliency to the deformable leg 39. When the thumb plate 13 is interiorly pressed from the outside, the pair of deformable legs 39 receive an outwardly curved shape, thereby enabling the inward deflection of the receiving element 15. The dimension of the opening 31*a* is selected so that a fan-and-strip-shaped clearance can be produced between the exposed side surface of the resilient leaf 32 and the curved inside surface of lock lever 31.

Figure 7:
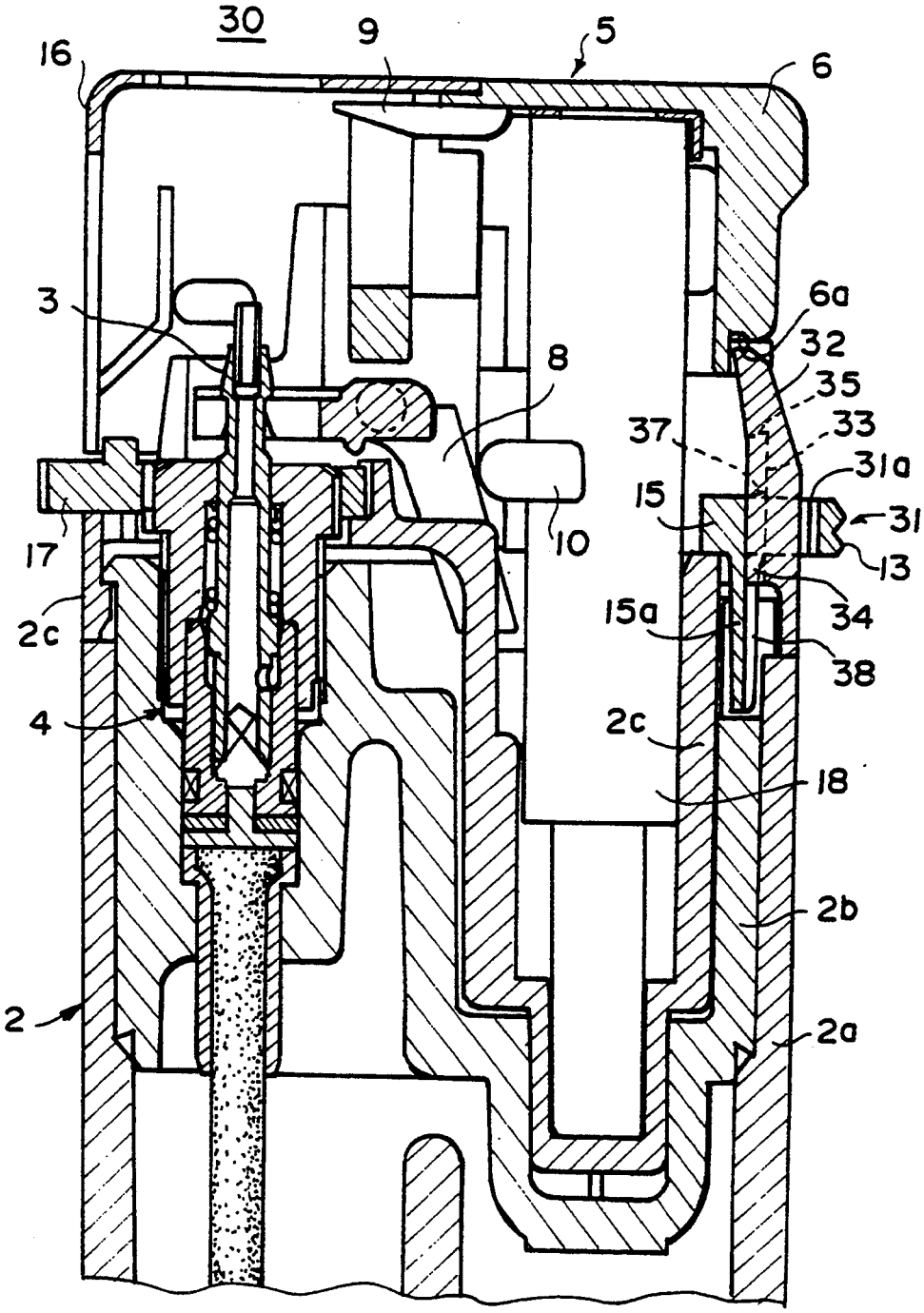
FIG. 7 is a side cross-sectional view showing a chief portion of a gas lighter with a safety device according to a third embodiment.

With reference to FIG. 7, the operation of the gas lighter, according to this embodiment, will now be described. In a normal state in which the lock lever 31 is situated at the locked position located at the lowermost end of the slits 11*a* and 11*b*, the upper end of the resilient leaf 32 is engaged with the recess 6*a* of the operation cap 6, thereby preventing the depression of the cap 6. Moreover, in this locked state, a play for the lock lever 31, i.e., a locked range, is longitudinally secured between the uppermost end of the engaging element 37 and the uppermost end of the guide channels 33.

Figure 11A:
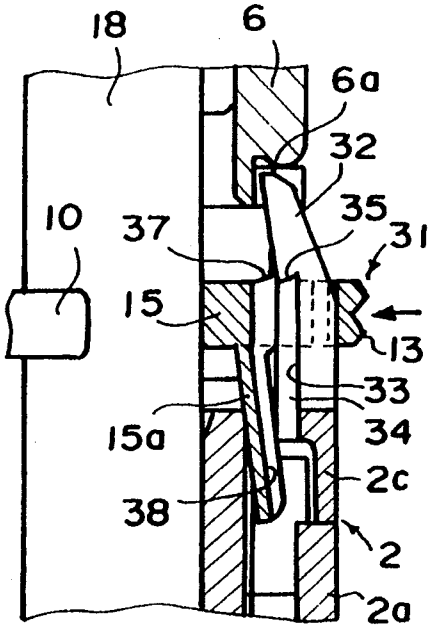
FIGS. 11A, 11B and 11C are cross-sectional views showing various activated states of a chief portion of the safety device shown in FIG. 7.
Figure 11B:
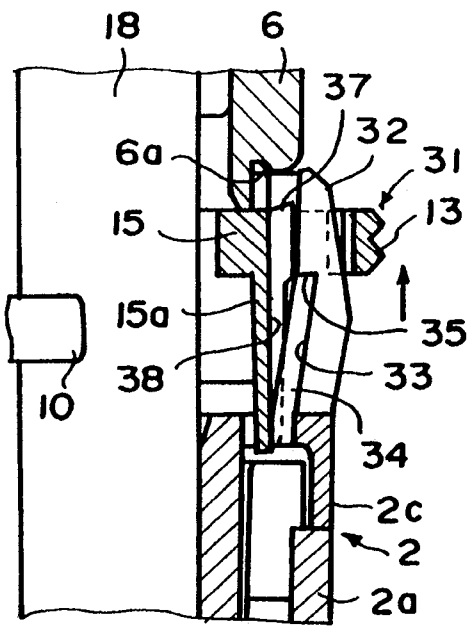

When the user uses the gas lighter 30, the lock lever 31 is thrust upward, as shown in FIG. 11B, to the unlocked position with the thumb plate 13 being pressed inwards, as shown in FIG. 11A.

In this course of action, the inward pressing of the lock lever 31 renders the deformable legs 39 on both sides of the thumb plate 13 exteriorly curved, so that the receiving element 15 of the lock lever 31 deflects inwardly. As a result of this, the uppermost end of the engaging element 37 is inwardly kept away from the stopper 35, thereby allowing the elevation of the lock lever. A contact between the engaging element 37 of the lock lever 31 and the inside surface of the incurved portion of the lock lever, i.e., the upper area above the stopper 35, renders the incurved upper portion of the resilient leaf 32 straightened, which in turn disengages the incurved portion from the recess 6*a* of the operation cap 6. Eventually, the lighter enters an unlocked state in which the operation cap 6 is depressible.

Figure 11C:
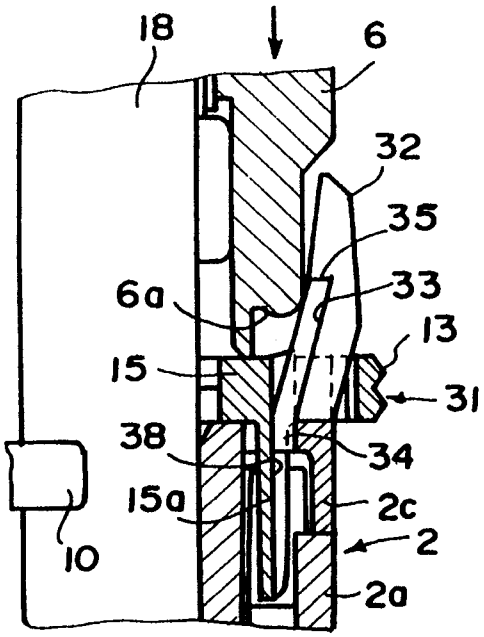

When the operation cap 6 is depressed as shown in FIG. 11C, the lighter is ignited. Concurrently, the lowermost end of the operation cap 6, in contact with the receiving element 15, forces downwardly the lock lever 31 to the locked position at the lowermost end of the slits. Then, in turn, the straightened portion of the resilient leaf 32 returns to its initial state, but that portion is brought in contact with the side wall of the operation cap 6.

Releasing the finger from the operation cap 6 allows the return of the same to its original elevated position, whereupon the upper end of the resilient leaf 32 receives an incurved shape in such a manner as to be engaged with the recess 6*a* of the operation cap 6, whereby the lighter automatically returns to the locked state.

Figure 12:
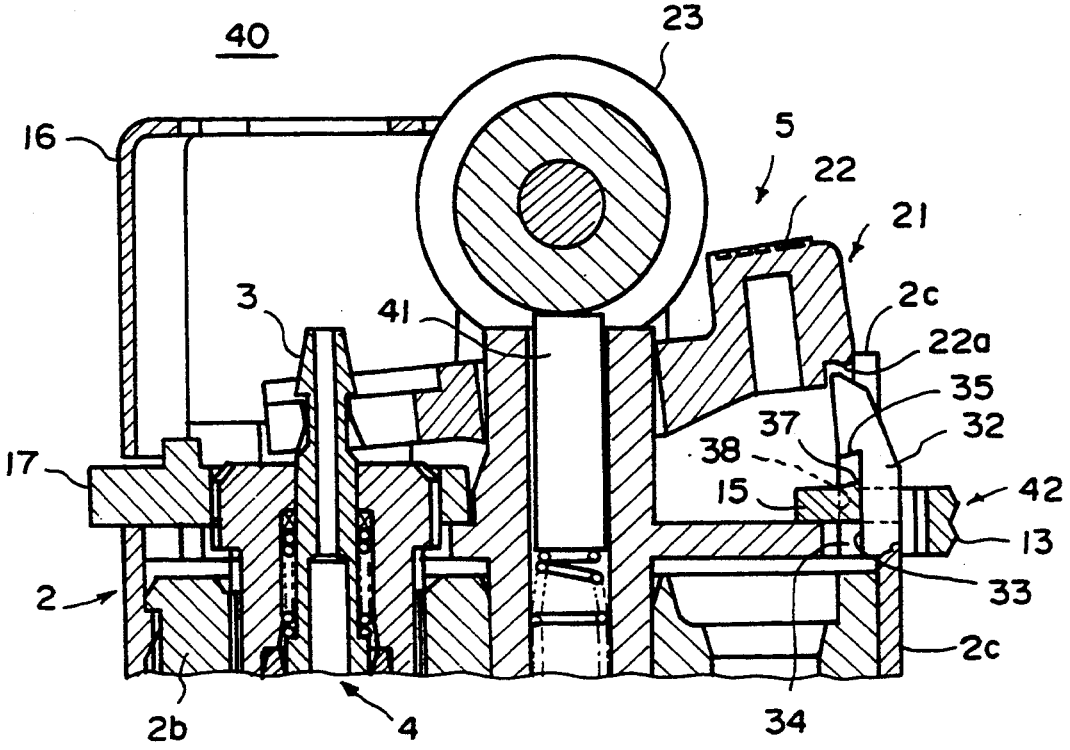
FIG. 12 is a cross-sectional view showing a chief portion of a gas lighter with a safety device according to a fourth embodiment of this invention.

Fourth Embodiment:

FIG. 12 shows a lighter 40 with a safety device according to another embodiment of this invention, wherein the lighter is a flint type gas lighter equipped with the safety device which is the same as is employed in the third embodiment. Like reference numerals are provided to like features in the first embodiment, and detailed explanation thereof will be omitted here for clarity.

The gas lighter, according to this embodiment, includes a flint 43 and the file 23. In this lighter, the ignition lever 21 at one end thereof engageably supporting the nozzle 3 is rockably supported, and the recess 22*a* of the operation means 22 is engaged with the upper end of the resilient leaf 32 which is formed as in the previous embodiment. A lock lever 42, through which the resilient leaf 32 travels, is the same in structure as the other switches of the previous embodiments, but different only in that the receiving element 15 lacks the leg 15*a*.

When the gas lighter 40 is in use, the lock lever 42 is pressed inwardly, in the same fashion as in the previous embodiment, and then thrust upwards to the unlocked position located at the uppermost end of the slits, with the engaging element 37 of the lock lever 42 being disengaged from the stopper 35. After the upper end of the resilient leaf 32 is straightened, the ignition lever 21 is depressed rotating the file 23, so that the lighter is ignited. In association with the depression of the ignition lever 21, the lock lever 42 is forced down to the locked position. Upon arrival of the ignition lever 21 at its initial elevated position, the incurved portion of the resilient leaf 32 is engaged with the recess 22*a* of the operation means 22, thereby preventing the depression of the ignition lever 21. Thus, the gas lighter automatically returns to the locked state.

It should be noted that the lock lever, which is disposed at the rear of the lighter body 2 throughout the aforementioned embodiments, may be disposed on either side surface of the lighter body 2.

Several embodiments of this invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to persons skilled in the art.

What is claimed is:

1. A gas lighter with a safety device comprising a lighter body containing fuel gas, fuel supply means for supplying the fuel gas contained in the lighter body to a nozzle at a regulated flow rate, ignition means for igniting the fuel gas flowing from the nozzle, depressible actuating means for opening and closing a fuel flow channel of the fuel supply means connected to the nozzle, resilient leaf means formed by longitudinal slits integrally formed in the upper end of the lighter body, the upper part of the resilient leaf means being movable between a locking position in which it is situated below a part of the depressible actuating means and an unlocking position in which it is spaced from the path of the depressible actuating means, and lock means including a manually-engageable portion slidable along an outer surface of the lighter body, the lock means being slidably engaged with the resilient leaf means in such a manner as to travel along a path extending longitudinally along the resilient leaf means so that, at one end of its path of motion, the lock means causes the upper part of the resilient leaf means to be disposed in the locking position so that the depression of the actuating means is prevented and, at the other end of its path of motion, the lock means causes the upper part of the resilient leaf means to be disposed in the unlocking position spaced from the path of the actuating means to allow the depression thereof.

2. A gas lighter with a safety device as defined in claim 1 wherein the depressible actuating means includes a cap member and a piezoelectric generator.

3. A gas lighter with a safety device as defined in claim 1 wherein the ignition means includes a file and a flint and the depressible actuating means includes a gas control lever.

4. A gas lighter with a safety defined comprising a lighter body containing fuel gas, fuel supply means for supplying the fuel gas contained in the lighter body to a nozzle at a regulated flow rate, ignition means for igniting the fuel gas flowing from the nozzle, depressible actuating means for opening and closing the fuel flow channel of the fuel connected to the nozzle, resilient leaf means formed by longitudinal slits integrally formed in the upper end of the lighter body, the upper part of the resilient leaf means being movable between a locking position in which it is situated below a part of the depressible actuating means and an unlocking position in which it is spaced from the patch of the depressible actuating means, and lock means slidably engaged with the resilient leaf means in such a manner as to travel along a path extending longitudinally along the resilient leaf means so that, at one end of its path of motion, the lock means causes the upper part of the resilient leaf means to be disposed in the locking position so that the depression of the actuating means is prevented and, at the other end of its path of motion, the lock means causes the upper part of the resilient leaf means to be disposed in the unlocking position paced from the path of the actuating means to allow the depression thereof, including stop means for preventing motion of the lock means toward the end of its path of motion at which the upper part of the resilient leaf means is moved to the unlocking position and wherein the stop means is disengaged from the lock means when the lock means is pressed inwardly.

5. A gas lighter with a safety device comprising a lighter body containing fuel gas, fuel supply means for supplying the fuel gas contained in the lighter body to a nozzle at a regulated flow rate, ignition means for igniting the fuel gas flowing from the nozzle, depressible actuating means for opening and closing a fuel flow channel of the fuel supply means connected to the nozzle, a safety device comprising resilient leaf means coacting with the lighter body and the depressible actuating means and formed by a pair of spaced longitudinal slits and having a locking portion which is movable between a locking position in which it produces an interengagement between the lighter body and the depressible actuating means, thereby preventing depression of the depressible actuating means, and an unlocking position in which it is displaced from interengagement between the lighter body and the depressible actuating means, thereby permitting depression of the depressible actuating means, a control member including a manually-engageable slidable portion engageable by sliding motion along an outer surface of the lighter body for controlling the safety device, and lock means for releasably holding the resilient leaf means in the unlocking position.

6. A gas lighter with a safety device as defined in claim 5 wherein the locking portion of the resilient leaf means is movable inwardly toward the interior of the lighter body to move it from the unlocking position to the locking position.

7. A gas lighter with a safety device as defined in claim 5 wherein the locking portion comprises an abutment formed on the resilient leaf means arranged to engage a corresponding abutment in the locking position.

8. A lighter for producing a flame on demand comprising:

a body;

a supply of flammable medium within said body;

a valve for controllably releasing the flammable medium for combustion having an open position for releasing the flammable medium for combustion, and a closed position preventing the release of the flammable medium;

first bias means operatively connected to the valve to urge the valve toward the closed position;

valve control means attached to the body having a fist surface adapted for manual actuation and an opposed second surface and being movable by manual actuation in a first direction to move said valve to the open position and in a second direction to allow the valve to move to the closed position; and safety means releasably positioned to prevent movement of the valve control means in the first direction when the valve is closed, the safety means including an abutment surface normally positioned to engage the opposed second surface of the valve control means to block movement thereof in the first direction when the valve is in the closed position;

second bias means to urge the abutment surface toward its normal position to prevent movement of the valve control means in the first direction; and release means including a manually-engageable slidable portion engageable by sliding motion along an outer surface of the body, the release means being movable against the bias of the second bias means to move the abutment surface to a position in which the abutment surface allows the valve control means to be moved in the first direction to move said valve to the open position, the valve control means further including, means for moving the release means to permit the bias of the second bias means to urge the abutment surface to restore it to its normal position to block movement of the valve control means.

9. A lighter for producing a flame on demand according to claim 8 wherein the second bias means to urge the abutment surface toward its normal position to prevent movement of the valve control means is a cantilever spring member provided in the body.

10. A lighter for producing a flame on demand comprising:

a body;

a supply of flammable medium within said body;

a valve for controllably releasing the flammable medium for combustion having an open position for releasing the flammable medium for combustion, and a closed position preventing the release of the flammable medium;

first bias means operatively connected to the valve to urge the valve toward the closed position;

valve control means attached to the body having a first surface adapted for manual actuation and an opposed second surface and being movable by manual actuation in a first direction to move said valve to the open position and in a second direction to allow the valve to move to the closed position; and safety means releasably positioned to prevent movement of the valve control means in the first direction when the valve is closed, the safety means including an abutment surface normally positioned to engage the opposed second surface of the valve control means to block movement thereof in the first direction when the valve is in the closed position;

second bias means to urge the abutment surface toward its normal position to prevent movement of the valve control means in the first direction; and release means provided in the valve body which is movable against the bias of the second bias means to move the abutment surface to a position in which the abutment surface allows the valve control means to be moved in the first direction to move said valve to the open position, the valve control means further including, means for moving the release means to permit the bias of the second bias means to urge the abutment surface to restore it to its normal position to block movement of the valve control means, wherein the abutment surface includes a wedge surface, and wherein the opposed second surface of the valve control means includes a V-shaped surface positioned to engage the wedge surface when the abutment surface is positioned to engage the valve control means to prevent movement thereof in the first direction, said wedge and V-shaped surfaces locking together to prevent movement of the abutment surface when they are engaged and manual pressure is applied to the first surface adapted for manual actuation.

11. A lighter for producing a flame on demand comprising:

a body;

a supply of flammable medium within said body;

a valve for controllably releasing the flammable medium for combustion having an open position for releasing the flammable medium for combustion, and a closed position preventing the release of the flammable medium;

first bias means operatively connected to the valve to urge the valve toward the closed position;

valve control means attached to the body having a first surface adapted for manual actuation and an opposed second surface and being movable by manual actuation in a first direction to move said valve to the open position and in a second direction to allow the valve to move to the closed position; and safety means releasably positioned to prevent movement of the valve control means in the first direction when the valve is closed, the safety means including an abutment surface normally positioned to engage the opposed second surface of the valve control means to block movement thereof in the first direction when the valve is in the closed position;

second bias means to urge the abutment surface toward its normal position to prevent movement of the valve control means in the first direction; and release means provided in the valve body which is movable against the bias of the second bias means to move the abutment surface to a position in which the abutment surface allows the valve control means to be moved in the first direction to move said valve to the open position, the valve control means further including, means for moving the release means to permit the bias of the second bias means to urge the abutment surface to restore it to its normal position to block movement of the valve control means, wherein the second bias means for urging the abutment surface toward its normal position to prevent movement of the valve control means includes a cantilever spring in the body and detent means.

12. A lighter for producing a flame on demand according to claim 11 wherein the release means comprises a slide member positioned against and movable on the cantilever spring and having a range of motion which is releasably restricted by the detent means.

13. A lighter for producing a flame on demand according to claim 11 wherein the release means includes a slide member embracing and slidable on the cantilever spring.

14. A lighter for producing a burning flammable medium on demand including:

a body;

a valve for controllably releasing flammable medium for combustion connected to the body and biased away from an open position toward a closed position;

manually operable valve control means operatively connected to the valve and including a first side adapted for manual actuation, a second side opposite to the first side and movable in a first direction of movement to move the valve to said open position and in a second direction of movement to allow movement of said valve to the closed position; and safety means releasably positionable manually to prevent movement of the valve control means in the first direction when the valve is closed, the safety means including:

an abutment surface normally positioned to engage the second side of the valve control means to block movement thereof in the first direction when said valve is in the closed position;

bias means to urge the abutment surface toward its normal position to block movement of said valve control means in the first direction; and a member including a manually-engageable slidable portion engageable by sliding motion along an outer surface of the body, the member being slidably supported adjacent the bias means and movable toward the second surface of the valve control means and toward the valve against the urging of the bias means to move the abutment surface to an unlock position wherein the abutment surface allows the valve control means to be moved in the first direction to move the valve to the open position, the valve control means further including:

means to move the slider member away from the unlock position after the valve control means has moved in the first direction, whereby the abutment surface is repositioned for engagement with the second side of the valve control means.

15. A lighter for producing a burning flammable medium on demand according to claim 14 wherein the bias means includes a cantilever spring in the body.

16. A lighter for producing a burning flammable medium on demand including:

a body;

a valve for controllably releasing flammable medium for combustion connected to the body and biased away from an open position toward a closed position;

manually operable valve control means operatively connected to the valve and including a first side adapted for manual actuation, a second side opposite to the first side and movable in a first direction of movement to move the valve to said open position and in a second direction of movement to allow movement of said valve to the closed position; and safety means releasably positionable manually to prevent movement of the valve control means in the first direction when the valve is closed, the safety means including an abutment surface normally positioned to engage the second side of the valve control means to block movement thereof in the first direction when said valve is in the closed position;

bias means to urge the abutment surface toward its normal position to block movement of said valve control means in the first direction; and a member slidably supported adjacent the bias means and movable toward the second surface of the valve control means and toward the valve against the urging of the bias means to move the abutment surface to an unlock position wherein the abutment surface allows the valve control means to be moved in the first direction to move the to the open position, the valve control means further including including:

means to move the slider member away from the unlock position after the valve control means has moved in the first direction, whereby the abutment surface is repositioned for engagement with the second side of the valve control means, wherein the abutment surface includes a wedge surface, and wherein the second side of the valve control means includes a wedge-retaining surface positioned to engage the wedge surface when the abutment surface is positioned to engage the valve control means to prevent movement thereof in the first direction, the wedge surface and the wedge-retaining surface being locked together when engaged and when manual pressure is being applied to the side adapted for manual actuation to prevent releasing movement of the valve control means.

17. A lighter for producing a burning flammable medium on demand including:

a body;

a valve for controllably releasing flammable medium for combustion connected to the body and biased away from an open position toward a closed position;

manually operable valve control means operatively connected to the valve and including a first side adapted for manual actuation, a second side opposite to the first side and movable in a first direction of movement to move the valve to said open position in a second direction of movement to allow movement of said valve to the closed position; and safety means releasably positionable manually to prevent movement of the valve control means in the first direction when the valve is closed, the safety means including:

an abutment surface normally positioned to engage the second side of the valve control means to block movement thereof in the first direction when said valve is in the closed position;

bias means to urge the abutment surface toward its normal position to block movement of said valve control means in the first direction; and a member slidably supported adjacent the bias means and movable toward the second surface of the valve control means and toward the valve against the urging of the bias means to move the abutment surface to an unlock position wherein the abutment surface allows the valve control means to be moved in the first direction to move the valve to the open position, the valve control means further including:

means to move the slider member away from the unlock position after the valve control means has moved in the first direction, whereby the abutment surface is repositioned for engagement with the second side of the valve control means, wherein the bias means includes a cantilever spring in the body and wherein the slider member has a passage to receive the cantilever spring.

18. A lighter for producing a burning flammable medium on demand comprising:

a body;

lighter actuation means having a first surface adapted for manual actuation and a second surface and being movable in a first direction of movement for actuation of the lighter and in a second direction of movement for deactivation of the lighter; and safety means releasably positioned to prevent movement of said lighter actuation means in the first direction for actuation of the lighter, the safety means including a resiliently-supported member having a first abutment surface normally positioned to engage the second surface of the lighter actuation means to block movement thereof in the first direction when the lighter is deactivated and detent means in the lighter body and the resiliently-supported member cooperating to releasably retain the resiliently-supported member;

the resiliently-supported member having a first position on a first side of the detent means and a second position on a second side of the detent means and being movable so that its abutment surface is positioned to allow movement of the lighter actuation means in the first direction when in the second position;

the resiliently-supported member having at least one portion in contact with the lighter body and being movable past the detent means from the first position to the second position; and including a return contact surface facing the second surface of the lighter actuation means positioned so that movement of the lighter actuation means in the first direction moves the resiliently-supported member from the second position to the first position.

19. A cigarette lighter that is difficult for a young person to actuate to produce a flame comprising:

a body;

actuating means for initiating ignition of the lighter;

a resilient member connected to the body and movable to a position in which actuation of the lighter is prevented;

a slidable member supported in sliding contact with the body and the resilient member and including a manually-engageable portion engageable by sliding motion along an outer surface of the body, the body and the resilient member being shaped so that sliding of the slidable member in a first direction moves the resilient member to allow actuation of the lighter; and means for moving the slidable member back to a position in which the actuation of the lighter is prevented after actuation thereof.

20. A cigarette lighter according to claim 19 wherein the resilient member is integral with the body.

21. A cigarette lighter according to claim 19 wherein the body includes guide means thereon and wherein the slidable member further includes follower means engaging the guide means to maintain angular orientation of the follower member with respect to the body.

22. A cigarette lighter that is difficult for a young person to actuate to produce a flame comprising:

a body;

a resilient member connected to the body and movable to a position in which actuation of the lighter is prevented;

a slidable member supported in sliding contact with the body and the resilient member, the body and the resilient member being shaped so that sliding of the slidable member in a first direction moves the resilient member to allow actuation of the lighter; and means for moving the slidable member back to a position in which the actuation of the lighter is prevented after actuation thereof, wherein the body includes:

guide means for restricting motion of the slidable member to the direction of sliding motion when the resilient member is unstressed, and the slidable member includes:

resilient contact means contacting the guide means to allow movement of the slidable member generally at a right angle to the direction of sliding motion; and means to restrict movement in the direction of sliding motion unless the sliding member is first moved generally at a right angle to the direction of sliding motion.

23. A cigarette lighter that is difficult for a young person to actuate to produce a flame comprising:

a body;

a resilient member connected to the body and movable to a position in which actuation of the lighter is prevented;

a slidable member supported in sliding contact with the body and the resilient member, the body and the resilient member being shaped so that sliding of the slidable member in a first direction moves the resilient member to allow actuation of the lighter; and means for moving the slidable member back to a position in which the actuation of the lighter is prevented after actuation thereof, wherein the resilient member includes an angled surface thereon and wherein sliding motion of the sliding member moves the resilient member by wedging the resilient member by contact with the angled surface and with the guide means.

24. A cigarette lighter according to claim 23 wherein the guide means includes at least one slot formed in the body.

25. A cigarette lighter that is difficult for a child to operate to produce a flame comprising:

a body;

actuating means for initiating ignition of the lighter;

resilient means connected to the body for normally preventing operation of the lighter;

a slidable member nonintegral with the body and slidably supported with respect to the body for sliding contact with the body and with the resilient means including a manually-engageable portion engageable by sliding motion along an outer surface of the body, the body and the resilient means being shaped so that movement of the slidable member in the direction of sliding motion moves the resilient means so that operation of the lighter is permitted; and means for moving the sliding member back to a position wherein operation of the lighter is prevented after an actuation thereof.

* * * * *

UNITED STATES PATENT AND TRADEMARK OFFICE

CERTIFICATE OF CORRECTION

PATENT NO. : 5,368,473

DATED : November 29, 1994

INVENTOR(S) : Kenjiro Uematsu et al.

It is certified that error appears in the above-identified patent and that said Letters Patent is hereby corrected as shown below:

Title page, under Item [19]: Change "Kenjiro" to --Uematsu--.

Column 1, line 5: The word "field" should read --filed--.

Column 6, line 52: The word "lightest" should read --lighter--.

Column 7, line 11: The word "incurred" should read --incurved--.

Column 8, line 45: The word "incurred" should read --incurved--.

Column 11, line 53: The word "defined" should read --device--; line 65: The word "patch" should read --path--.

Column 12, line 61: The word "fist" should read --first--.

UNITED STATES PATENT AND TRADEMARK OFFICE

CERTIFICATE OF CORRECTION

PATENT NO. : 5,368,473

DATED : November 29, 1994

INVENTOR(S) : Kenjiro Uematsu et al.

It is certified that error appears in the above-identified patent and that said Letters Patent is hereby corrected as shown below:

Column 16, line 7: The words "move the" should read --move the valve--; line 39: The word "in" should read --and in--.

Signed and Sealed this

Twenty-first Day of March, 1995

*Attest:*

*Attesting Officer*

BRUCE LEHMAN

*Commissioner of Patents and Trademarks*